United States Patent [19]

Ishikawa

[11] 4,299,434

[45] Nov. 10, 1981

[54] WATERTIGHT RF CONNECTOR

[76] Inventor: Asao Ishikawa, 15-2, 3-chome, Higashi, Tokyo, Japan

[21] Appl. No.: 5,658

[22] Filed: Jan. 22, 1979

Related U.S. Application Data

[63] Continuation of Ser. No. 840,113, Oct. 6, 1977, abandoned.

[30] Foreign Application Priority Data

Apr. 30, 1977 [JP] Japan ..... 52/55560

[51] Int. Cl.[3] ..... H01R 4/24; H01R 11/20

[52] U.S. Cl. ..... 339/96; 339/177 E

[58] Field of Search ..... 339/96, 177, 60, 94

[56] References Cited

U.S. PATENT DOCUMENTS

| | | | |
|---|---|---|---|
| 2,439,589 | 4/1948 | Sundell | 339/96 X |
| 2,642,474 | 6/1953 | Bowar | 339/60 C X |
| 3,127,230 | 3/1964 | Marquis et al. | 339/96 X |
| 3,158,420 | 11/1964 | Olson et al. | 339/96 |
| 3,522,576 | 8/1970 | Cairns | 339/96 X |
| 3,768,063 | 10/1973 | Coffman | 339/177 E X |
| 3,976,347 | 8/1976 | Cooke | 339/96 X |

FOREIGN PATENT DOCUMENTS

| | | | |
|---|---|---|---|
| 2302606 | 9/1976 | France | 339/96 |

*Primary Examiner*—John McQuade
*Assistant Examiner*—John S. Brown
*Attorney, Agent, or Firm*—Hubbell, Cohen, Stiefel & Gross

[57] ABSTRACT

A watertight RF coaxial jack connector is provided which includes an elastomeric layer disposed in sealing relationship with its upper opening. The layer is formed so as to guide the center pin of a mating coaxial plug connector to puncture the layer and engage a split pin provided within the jack connector body. A watertight seal is thereby effected for preventing moisture from entering inside the jack connector through the upper opening. A second elastomeric layer is mounted within the jack body beneath the first layer. The second layer both supports the split pin and exerts an upward compressive force on the first elastomeric layer.

9 Claims, 7 Drawing Figures

WATERTIGHT RF CONNECTOR

This is a continuation, of application Ser. No. 840,113, filed Oct. 6, 1977, and now abandoned.

BACKGROUND OF THE INVENTION

1. Field of the Invention

This invention relates generally to RF connectors and particularly to watertight RF coaxial connectors, and includes means for preventing water outside the connectors from entering therein.

2. Description of the Prior Art

The growing popularity of coaxial cable television systems has brought an increased demand for weatherproofed, in-line TV components such as signal amplifiers, splitters and couplers. For optimum performance, it is sometimes desirable to place these components close to an outside receiving antenna, necessitating their location out of doors. For average consumer applications, cost becomes a factor to be considered when designing weatherproofed components such as those mentioned above.

Jack type coaxial cable connectors provided on these components pose a serious waterproofing problem in that they each must have a top opening to allow a center conductor in a mating coaxial plug connector to pass into the jack to engage a split pin therein. These jack connectors may be integrally formed on a component housing which contains electrical devices operative to amplify, distribute or otherwise process the TV signal. Certainly, if a coaxial plug connector is not mated to the jack connector body, water may freely pass through the opening and adversely affect the devices inside the housing. Also, the split pin, which is provided immediately below the opening within the jack body, may undergo corrosion. Even when a coaxial cable has a plug connector mated onto the jack body, water flowing downwardly along the cable may pass through the plug connector and enter inside the jack body through the top opening therein.

In order to prevent water or moisture from entering the component housing, it is known to provide an epoxy resin seal at the bottom of the jack body within the housing, thereby preventing water which enters the jack body from passing on into the housing. However, water still accumulates within the jack body itself and, as a result, deleteriously affects the split pin and insulation material disposed within the jack body.

SUMMARY OF THE INVENTION

The above and other shortcomings in the known methods of sealing RF jack connectors are overcome by providing a resilient elastomeric layer which is fixedly secured within the jack body and extends across the top opening therein. The external surface of the elastomeric layer is formed to receive and guide the center conductor in a mating coaxial plug connector, so that it will puncture the elastomeric layer and operatively engage the split pin inside the jack body. A second elastomeric layer is mounted within the jack body beneath the first layer. The second layer both supports the split pin and exerts an upward compressive force on the first elastomeric layer.

DESCRIPTION OF THE PREFERRED EMBODIMENT

Figure 1:
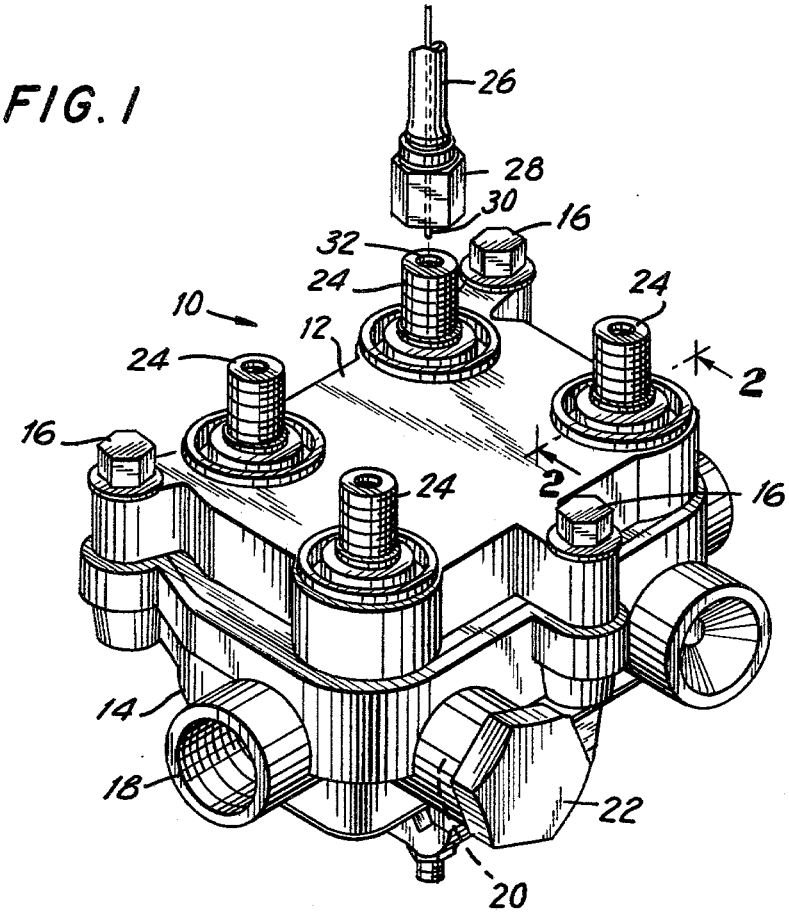
FIG. 1 is a perspective view of a conventional four-way TV cable coupler having four jack connector bodies integrally formed on its housing.

Referring in detail to the drawings and particularly to FIG. 1 thereof, there is illustrated a four-way cable TV splitter 10 having a housing comprising an upper shell 12 and a lower shell 14. A number of electrical components, not shown in the figure, are disposed within the housing and operate to distribute a TV signal entering the splitter to four output terminals 24. The housing shells 12, 14 are joined together by way of three bolts 16. A ring gasket, not shown in the figure, is compressed between the shells 12, 14 to provide a watertight seal.

The incoming TV signal is brought to the splitter 10 by way of a cable (not shown) having a connector which engages the opening 18 formed through the shell 14 of the splitter 10. Another opening 20 may be formed through the shell 14, the opening 20 being capped by a cover nut 22 in the particular splitter shown. The four TV output signals from the splitter 10 are made available by way of four coaxial jack connectors 24, respectively, the bodies of the connectors 24 being integrally formed with the shell 12 of the splitter 10. A coaxial cable 26 may be connected by way of a plug connector 28 to any one of the jacks 24. When so connected, a center conductor 30 extending within the plug connector 28 passes through an opening 32 provided at the top of the jack connector body 24, and engages a split pin 38 located within the jack body 24. The split pin 38, shown in FIG. 2, is electrically connected to the circuit provided inside of the housing of the splitter 10 by way of a contact pin 40.

Figure 2:
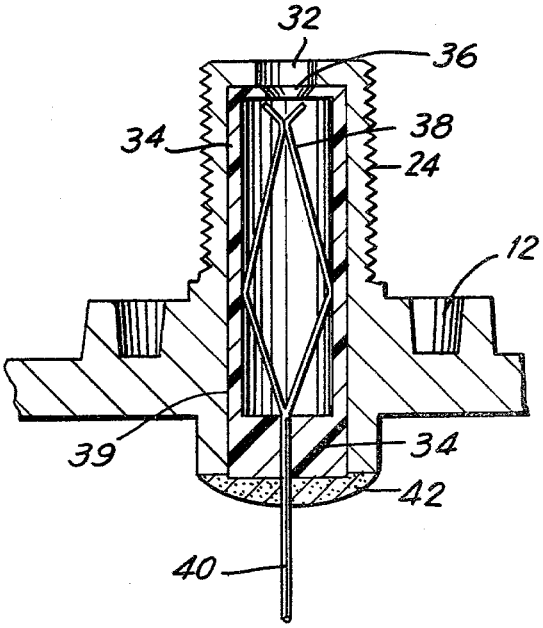
FIG. 2 PRIOR ART
FIG. 2 is a cross-sectional view of a conventional (prior art) coaxial jack connector body taken along line 2—2 of FIG. 1.

FIG. 2 shows, in section, a jack connector body 24 and its internal elements, all according to the prior art. The split pin 38 is coaxially disposed within a bore 39 extending through the jack body 24. The end of the split pin 38 is formed to receive and make electrical contact with a coaxial cable center conductor 30 (FIG. 1), and is disposed in alignment below the top opening 32. Surrounding the split pin 38 and coaxially disposed within the bore of the jack connector body 24 is a plastic insulating sleeve 34. The sleeve 34 acts to prevent electrical contact between the sides of the split pin 38 and the inside wall of the jack connector body 24. A contact pin 40 extends out from the bottom of the split pin 38 and passes through the bottom of the insulating sleeve 34 to connect to electrical devices (not shown) within the housing of the splitter 10. An opening 36 is provided at the top of the insulating sleeve 34 to permit the coaxial plug connector center conductor 30 to pass therethrough for engaging the split pin 38. An epoxy resin seal 42 is deposited across the bottom of the insulating sleeve 34 and the surrounding portion of the housing shell 12. This epoxy resin seal 42 acts to prevent water which enters the openings 32, 36 and passes down within the insulating sleeve 34 from running out along the contact pin 40.

While the epoxy seal 42 may prevent water from entering inside the shell 12 to adversely affect the electrical devices therein, it is clear that water can still collect within the insulting sleeve 34 and cause it to deteriorate, as well as adversely affect and corrode the split pin 38. This then leads to the physical and electrical breakdown of the insulating sleeve 34, and electrical shorting between the split pin 38 and the inside surface of the jack connector body 24 may occur. Even before a direct short circuit occurs, the RF insulating properties of the sleeve 34 may be so harmfully affected as to cause high loss of the TV signal which passes along the split pin 38. Further, the split pin 38 itself may corrode to such a degree that good RF contact is lost between the split pin 38 and the center conductor 30 when the RF coaxial plug connector 28 is mated to the jack connector body 24.

Also, the epoxy seal 42 is likely to loosen and break away from the bottom of the insulating sleeve 34 as a result of repeated temperature changes over a period of time. Failure of the epoxy seal 42 allows passage of water and moisture into the shell 12, thereby causing eventual deterioration of the electrical devices comprising the circuit of the splitter 10.

Figure 3:
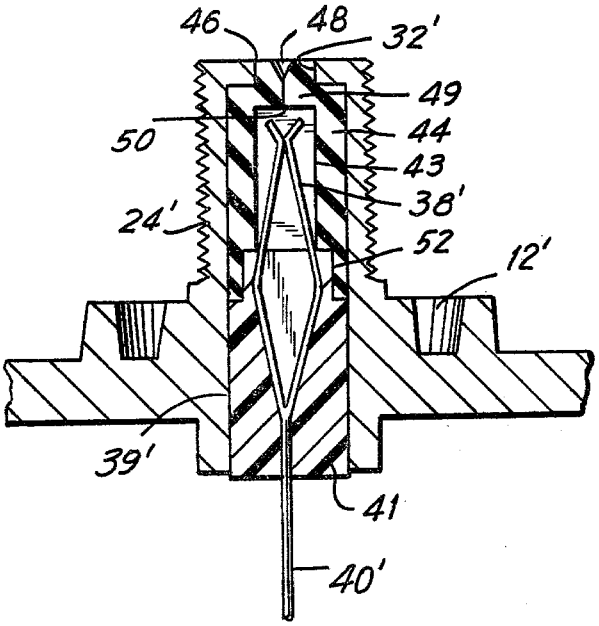
FIG. 3 is a sectional view of the jack connector body assembly of the present invention.

One embodiment of the coaxial jack assembly of the present invention is shown in FIG. 3. In place of the conventional insulating sleeve 34 shown in FIG. 2, a resilient elastomeric sleeve 44 is coaxially disposed within bore 39' in jack connector body 24'. Also extending coaxially in the bore 39' of the jack body 24', and disposed below the elastomeric sleeve 44, is an insulative support sleeve 41 which is formed to operatively support split pin 38', and may be made of any suitable insulating material such as a thermoplastic, for example, polyolefins such as polyethylene, polystyrene, etc., or a thermosetting resin such as, e.g., urea-formaldehyde, phenol-formaldehyde, etc. Both the support sleeve 41 and the elastomeric sleeve 44 act to electrically insulate the split pin 38' from the inside wall of the jack connector body 24'. A contact pin 40' extends from the bottom of the split pin 38' down into the housing of the splitter 10 to connect to the electrical devices therein.

Figure 4:
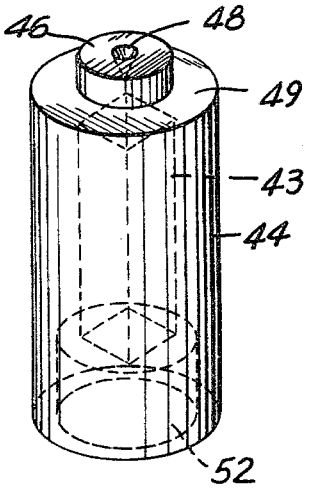
FIG. 4 is a perspective view of an elastomeric sleeve member which is disposed within the jack connector body of FIG. 3.

Referring again to the elastomeric sleeve 44, which is shown in perspective in FIG. 4, an axial bore 43 is provided within the sleeve 44 extending upwardly from its bottom open end and terminating at a closed top end wall 49. The lower portion 52 of the bore 43 through the elastomeric sleeve 44 is shaped to complementarily fit around a raised shoulder provided on the support sleeve 41. The upper portion of the bore 43 through the elastomeric sleeve 44 desirably has a cross-section formed to closely accommodate the upper portion of the split pin 38 which may have, for example, a square cross-section.

The top end wall 49 of the elastomeric sleeve 44 has a protrusion 46 formed on its outside surface to extend through the opening 32' at the top of the jack connector body 24'. An opening or guideway 48 is provided extending into the protrusion 46 to a predetermined depth so that a substantially thin top wall 50 is defined above the split pin 38'. The opening 48 is preferably conically tapered to guide the center conductor 30 in the coaxial plug connector 28 (FIG. 1) to puncture the thin wall 50, and to engage the split pin 38' when the plug 28 is mated to the jack body 24'.

The relative dimensions of the sleeve 44 and the bore openings 43, 52 therein are for purposes of illustration only and may be varied in order to conform with other jack connector bodies and split pins than those illustrated herein. Similarly, the protrusion 46 is dimensioned to fit through the opening 32' in the jack body 24', and it may also project out above the top opening 32' in jack body 24' a predetermined distance so that when the plug connector 28 is mated to the jack body 24', the protrusion 46 forcibly bears against the inside face of the plug connector 28 thereby providing additional watertight sealing. Such protrusions are discussed later in regard to FIGS. 5 and 6.

Figure 5:
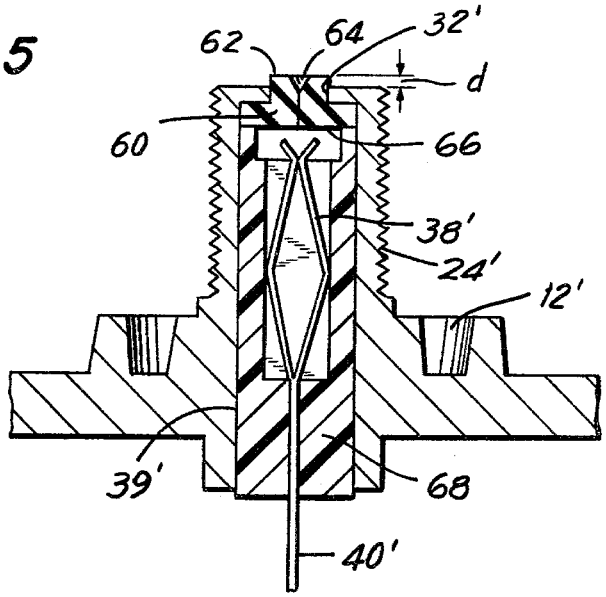
FIG. 5 is a sectional view of the jack connector body in FIG. 3 having an elastomeric layer secured across the top thereof.

Water sealing properties as obtained by using the elastomeric sleeve 44 above described may also be realized by tightly securing an elastomeric layer 60 in sealing relationship immediately below the opening 32' in the jack body 24', as shown in FIG. 5. The layer 60 has a protrusion 62 with a preferably conical guideway 64 formed on its external surface to guide the center conductor 30 in the mating plug connector 28 for engaging the split pin 38'. A thin wall 66 remains in the layer 60 immediately above the split pin 38' so that a watertight seal exists at the opening 32' even before the center conductor 30 punctures the thin wall 66.

The protrusion 62 may project out above the top wall of the jack body 24' for a distance d so as to enable a watertight compression seal to be effected between the protrusion 62 and the inside face of plug connector 28 when connector 28 is mated to the jack body 24'. For a standard type "F" jack body 24', it has been found that the protrusion 62 should preferably extend about 0.5 millimeters above the top of the jack. In order to ensure that the above mentioned compression seal is in fact achieved, an insulative support sleeve 68 is dimensionally formed to maintain a pressure contact with the underside of the layer 60 when the support sleeve 68 is operatively disposed within the jack body 24'. The layer 60 is thereby squeeze-fitted between the top end of the support sleeve 68 and the underside of the top wall of the jack body 24', as shown in FIG. 5.

Support sleeve 68 can be formed of electrically insulative materials such as, for example, any of those defined above with respect to the support sleeve 41 in FIG. 3.

Figure 6:
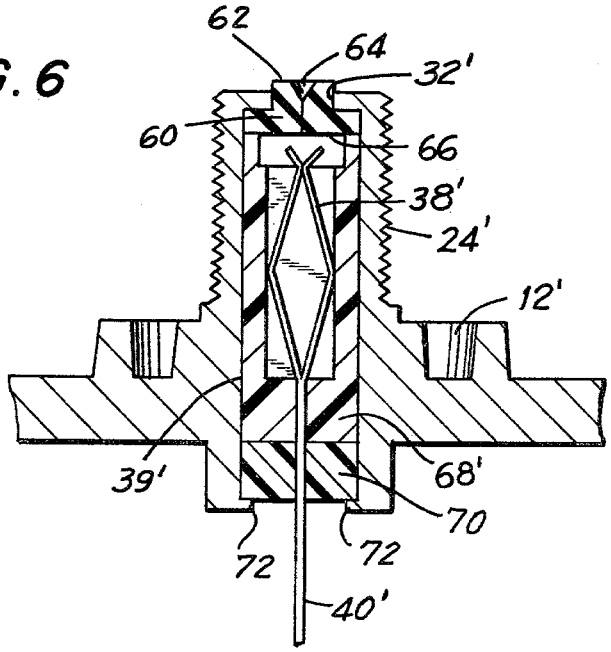
FIG. 6 is a sectional view of the jack connector body in FIG. 3 having elastomeric layers secured across the top and bottom thereof; and FIG, 7 is a sectional view of the jack connector body in FIG. 3 mated to a coaxial plug connector.

For additional water sealing protection at the bottom of the jack body 24', another elastomeric layer 70 can be disposed thereat in sealing relationship with the contact pin 40' and the lower portion of the interior of the jack body 24', as shown in FIG. 6. In such case, the lower portion of jack body 24' can be formed with an interiorally disposed, circumferential annular lip 72 which fixedly retains the layer 70 in tight sealing relationship with the contact pin 40' and the lower portion of jack body 24' by maintaining the layer 70 in compression against the bottom of support sleeve 68'. It will be appreciated that the layer 60 at the top of the jack body 24' will be securely held thereat by the top end of support sleeve 68' which forcibly bears against the underside of the layer 60.

Figure 7:
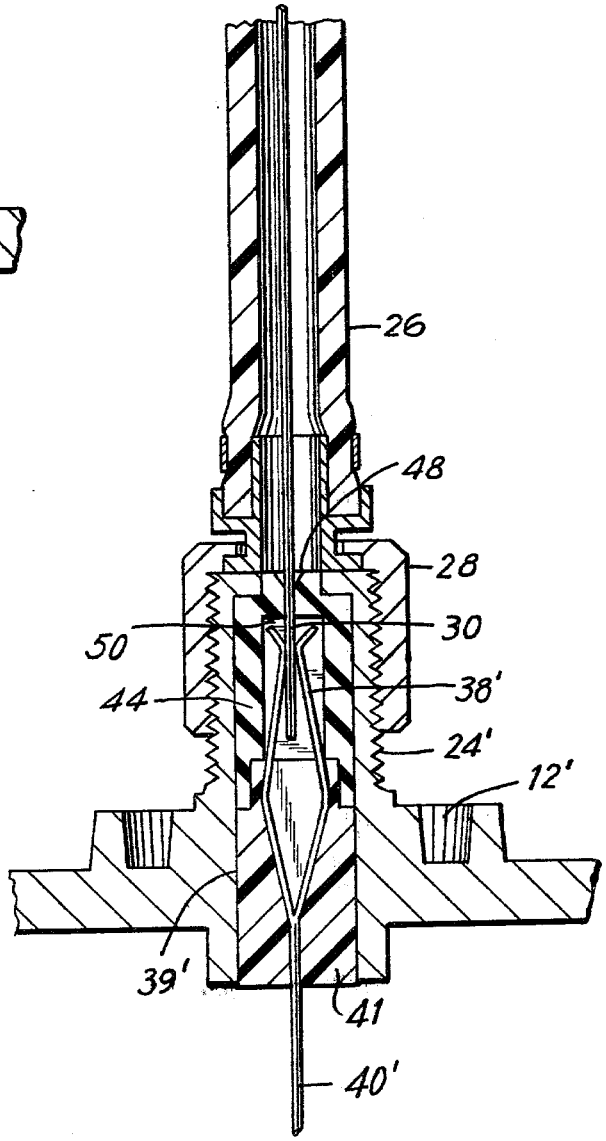

The mating configuration for the jack connector body assembly of the present invention including, for example, elastomeric sleeve 44 is shown in FIG. 7 wherein the center conductor 30 of cable 26 engages split pin 38' when plug 28 is threaded onto jack body 24'. Once the center conductor 30, after passing through the guideway opening 48, punctures the top thin wall 50 of the elastomeric sleeve 44, it will be appreciated that a watertight seal is maintained between the punctured thin wall 50 and the center conductor 30. Of course, before the plug connector 28 is mated to the jack body 24', the thin wall 50, being unbroken, will itself prevent water from entering within the jack body 24' as noted above.

The material for the elastomeric sleeve 44, the layer 60 and the layer 70 may be any of the conventional elastomeric materials, e.g., natural rubber, synthetic rubbers such as SBR, ABR, polysulfide rubber, ethylenepropylene copolymer and terpolymer rubber, silicone rubber, etc. In the preferred embodiment, the sleeve 44, layer 60 and layer 70 are made from neoprene.

The coaxial jack connector assembly described hereinabove can be easily and quickly assembled to provide a watertight jack far superior to others commonly used. The prior conventional method of sealing the contact pin, insulating sleeve and surrounding housing body with an epoxy resin did not correct the problem of water seepage inside the connector body itself. Further, when using an epoxy seal, it is virtually impossible to repair or replace the split pin or insulating sleeve should they deteriorate. With the present invention, repair or replacement of the split pin and support sleeve, or the elastomeric sleeve or layers themselves, may be easily accomplished because of the elimination of the cement seals heretofore used.

What is claimed as new and desired to be secured by Letters Patent is:

1. In an RF coaxial jack connector of the type used in a coaxial cable television distribution system, said jack connector including a base having at least one tubular shaped jack body extending outwardly therefrom, said jack body having a hollow interior and having an opening at its outwardly extending end, and an electrically conductive split pin disposed within said jack body for enaging a coaxial plug insertably received therein through said opening on said jack body;

the improvement comprising:

a first resilient elastomeric layer affixed to the inner surface of said jack body in sealing relationship therewith, a portion of said first resilient elastomeric layer being positioned within said jack body to cover said opening at the outwardly extending end thereof for preventing water from entering said jack body through said opening before said coaxial plug is received therein, said portion of said first resilient elastomeric layer covering said opening being sufficiently thin to be punctured by said coaxial plug when said coaxial plug is inserted into said jack body, whereby said first resilient elastomeric layer provides a watertight seal for said jack body both before and after said coaxial plug is inserted therein; and a second resilient elastomeric layer mounted within said jack body beneath said first resilient elastomeric layer and in substantial axial alignment therewith, said second layer being formed complementary to the portion of said split pin surrounded thereby, whereby said second layer supports said split pin and exerts an upward compressive force on said first resilient elastomeric layer.

2. A jack connector as claimed in claim 1 further including a guideway defined in said portion of said first resilient elastomeric layer covering said jack opening for guiding said coaxial plug through said jack opening.

3. A jack connector as claimed in claim 1 wherein said portion of said first resilient elastomeric layer covering said jack opening extends outwardly from said jack opening.

4. A jack connector as claimed in claim 3 wherein said portion of said first resilient elastomeric layer covering said jack opening extends approximately 0.5 millimeters outwardly from said jack opening.

5. A jack connector as claimed in claim 1 wherein said outwardly extending end of said jack body is configured to define a substantially perpendicular, inwardly directed wall for reducing the diameter of said hollow interior of said jack body at said outwardly extending end thereof.

6. A jack connector as claimed in claim 1 further including an insulative supporting sleeve interposed between said first and second resilient elastomeric layers.

7. A jack connector as claimed in claim 6 wherein said insulative supporting sleeve is formed from a thermoplastic material.

8. A jack connector as claimed in claim 1 further including means defined within said jack body for retaining said second resilient elastomeric layer in substantial axial alignment with said first resilient elastomeric layer.

9. A jack connector as claimed in claim 1 wherein said first resilient elastomeric layer is formed from neoprene.

* * * * *